US007570890B2

(12) United States Patent
Evans

(10) Patent No.: US 7,570,890 B2
(45) **Date of Patent: *Aug. 4, 2009**

(54) HYBRID PRINTER AND RELATED SYSTEM AND METHOD

(75) Inventor: Charles E. Evans, Corvallis, OR (US)

(73) Assignee: Marvell International Technology Ltd. (BM)

( * ) Notice: Subject to any disclaimer, the term of this patent is extended or adjusted under 35 U.S.C. 154(b) by 0 days.

This patent is subject to a terminal disclaimer.

(21) Appl. No.: 11/903,651

(22) Filed: Sep. 24, 2007

(65) Prior Publication Data

US 2008/0150976 A1 Jun. 26, 2008

Related U.S. Application Data

(63) Continuation of application No. 11/087,284, filed on Mar. 22, 2005, now Pat. No. 7,274,883.

(51) Int. Cl.
*G03G 15/00* (2006.01)

(52) U.S. Cl. ..... 399/2; 347/2; 399/6; 399/15

(58) Field of Classification Search ..... 399/1, 399/2, 6, 107, 130, 15, 301, 394; 347/2
See application file for complete search history.

(56) References Cited

U.S. PATENT DOCUMENTS

| | | | | |
|---|---|---|---|---|
| 5,081,596 | A | 1/1992 | Vincent et al. | 358/1.4 |
| 5,561,500 | A | 10/1996 | Ohzeki et al. | 399/85 |
| 5,570,451 | A | 10/1996 | Sakaizawa et al. | 399/2 |
| 5,592,262 | A | 1/1997 | Tanaka et al. | 399/1 |
| 5,729,785 | A | 3/1998 | Sakaizawa et al. | 399/2 |
| 5,734,390 | A | 3/1998 | Sakaizawa et al. | 399/2 |
| 5,790,915 | A | 8/1998 | Arcaro et al. | 399/2 |
| 7,274,883 | B2 | 9/2007 | Evans | 399/2 |
| 2002/0106208 | A1 | 8/2002 | Oakeson et al. | 399/2 |
| 2002/0191978 | A1 | 12/2002 | Morimoto | 399/2 |
| 2003/0113123 | A1 | 6/2003 | Yamaguchi et al. | 399/2 |
| 2004/0005155 | A1 | 1/2004 | Miyazaki | 399/2 |

FOREIGN PATENT DOCUMENTS

| | | | |
|---|---|---|---|
| JP | 60-045267 | A | 3/1988 |
| JP | 63-173071 | A | 7/1988 |
| JP | 08-095463 | A | 4/1996 |
| JP | 08-272258 | A | 10/1996 |
| JP | 09-094942 | A | 4/1997 |
| JP | 09-136452 | A | 5/1997 |
| JP | 10-147013 | A | 6/1998 |
| JP | 10-23059 | A1 | 9/1998 |

*Primary Examiner*—Sophia S Chen

(57) ABSTRACT

A hybrid printing assembly includes a first printing subassembly operable to produce a first pattern on a medium, and a second printing subassembly operable to generate a second pattern on the medium.

20 Claims, 7 Drawing Sheets

HYBRID PRINTER AND RELATED SYSTEM AND METHOD

This application is a continuation of U.S. patent application Ser. No. 11/087,284, filed Mar. 22, 2005, (now U.S. Pat. No. 7,274,883), the entire contents of which are incorporated herein by reference.

BACKGROUND

Today, the two leading types of printers on the market are laser printers and inkjet printers. In general, laser printers utilize toner to produce images, while inkjet printers produce images by depositing ink.

Laser printers and inkjet printers have major differences in performance and price. In general, laser printers are significantly faster and have a greater printing duty cycle than inkjet printers. In addition, laser printers typically have significantly lower operating costs than inkjet printers. However, inkjet printers are capable of producing photo-quality images at higher resolutions than laser printers. And inkjet printers are typically significantly less expensive than color laser printers.

As a result, most of the printers on the market are monochrome laser printers and color inkjet printers. Office computer networks typically include a monochrome laser printer for large-volume and rapid printing, and typically use a color inkjet printer for the occasional color print job. However, this approach not only involves the expense of purchasing at least two separate printers, but also the expense of supporting and maintaining the at least two separate printers. There are few, if any, printers available that have the speed and duty cycle of a laser printer as well as the color and resolution of an inkjet printer at a reasonable price.

FIG. 1 is a diagram of a typical laser printer 10 including a movable photoreceptor 12, typically a revolving drum or cylinder. This drum 12 is made out of a highly photoconductive material that is discharged by light photons. Initially, the photoreceptor drum 12 is given a total positive charge by a charging electrode 14, typically a wire or roller having a current running through it. As the drum 12 revolves, the printer 10 uses a laser unit 16 (such as a laser diode) to shine a laser beam 18 across the surface of the drum 12 to discharge certain points. In this manner, the laser beam 18 "draws" the text and images to be printed as a pattern of electrical discharges (an electrostatic image) on the drum 12. If the on-time or intensity of the laser beam 18 is modulated, resulting variations in charge on the drum 12 will ultimately be translated to proportionate amounts of toner deposited on a print medium 21 such as paper.

In scanning the laser beam 18 across the drum 12, the laser unit 16 does not actually move the laser beam 18 itself but instead bounces the laser beam 18 off of a movable mirror 26, such as a rotating mirror or an oscillating mirror. As the mirror 26 moves, it reflects the laser beam 18 through a series of lenses (not shown) and onto the drum 12. These lenses change characteristics of the light beam 18 to compensate for image distortion that would otherwise be caused by the varying distance between the mirror 26 and points along the drum 12.

After the laser beam 18 begins scanning the desired electrostatic pattern on the drum 12, the printer 10 uses a toner roller 20 to coat the drum 12 with positively charged toner powder. Since the toner has a positive charge, it clings to the negative discharged areas of the drum 12 that have been scanned by the laser beam, but the toner does not cling to the positively charged "background" of the drum. With the toner pattern affixed to the drum 12, the drum rolls over the sheet of paper 21 traveling below it. Before the paper 21 travels under the drum 12, the paper is given a negative charge that is stronger than the negative charge of the electrostatic image on the drum 12 so that the paper pulls the toner powder away from the drum 12. Finally, the printer 10 passes the paper 21 through a fuser 24, which is typically a pair of heated rollers. As the paper 21 passes through the fuser 24, the loose toner powder on the paper melts, fusing with the fibers in the paper and forming a permanent image on the paper.

After the toner on the drum 12 is transferred to the paper 21, the drum surface rotates past a discharge lamp 22, which generates a bright light that exposes the photoreceptor surface of the drum 12, erasing the electrostatic image. The drum surface then passes the charging electrode 14, which reapplies a positive charge to the surface of the drum 12 in anticipation of the laser beam 18 scanning the next portion of the image to be printed onto the drum. In this way, the scanning of the laser, the transfer of the toner, and the erasing of the photoreceptor surface is a continuous process that may be repeated before the printing of an entire image is complete.

FIG. 2 is a perspective view of portions of the laser printer 10 in FIG. 1 better showing the scanning of the laser beam 18 in a horizontal direction across the drum 12 as indicated by an arrow 28. Image processing circuitry (not shown) controls the laser unit 16 to modulate the laser beam 18 as the beam scans across the drum 12 in the horizontal direction 28 one line at a time. The image processing circuitry controls the laser unit 16 to turn ON and emit a pulse of light for every dot to be printed in a given horizontal line and to turn OFF where no dots are to be printed in the line.

Laser printers typically have several advantages when compared to other types of printers. For example, laser printers often produce documents with the highest text and line quality. This is because laser printers use toner, which sits crisply on top of the paper and does not spread like ink does as it is absorbed by the paper. Also, the cost of operating a laser printer is typically low; certain toner cartridges have average yields of over 40,000 pages. This allows laser printers to have a cost per page as low as one cent. In addition, laser printers are often designed to print pages at a high rate; current laser printers can print black-and-white documents at speeds of up to 85 pages per minute (ppm).

Laser printers do, however, have certain limitations. To print in color, laser printers typically have a separate toner cartridge for each of the primary colors. Consequently, instead of a single black toner cartridge, a color laser printer often has four toner cartridges (e.g., black, red, yellow, blue). In addition, the architecture of a color laser printer is often significantly more complex than the architecture of a black-and-white laser printer. For example, the four toner cartridges either share the same drum so that four passes of the paper are made over the same drum, or have their own respective drums so that the paper passes over four separate drums in series. As a result, the cost of a color laser printer is typically higher than the costs of other types of color printers. Also, because overlapping toner colors may reduce image resolution and quality, color laser printers often produce color images that are lower in resolution and quality than comparable color images produced by other types of color printers.

FIG. 3 is a perspective view of a typical inkjet printer 30 that emits droplets of ink (not shown) onto print media 32, such as paper, to create images and text. The inkjet printer 30 includes a printhead (not shown) mounted within a carriage 34 that travels back and forth across the paper 32. The printhead includes an array of tiny nozzles (not shown) that emit the droplets of ink. As the printhead moves across the paper 32, a controller activates the printhead to emit droplets of ink at precise locations corresponding to a pattern of pixels of the image being printed.

Ink is typically provided to the printhead by an ink cartridge 36 that is attached to the carriage 34. Depending on the design of the printer 30, the ink cartridge 36 can come in various combinations ranging from a single cartridge for black ink to multiple cartridges each for an ink of a desired color. The ink cartridge 36 may even include the printhead itself. Alternatively, the ink cartridge 36 may be a stationary ink reservoir that is separate from the carriage 34 and connected to the printhead by a hose.

Different types of inkjet printers emit the droplets of ink in different ways. The two main inkjet technologies currently used by printer manufacturers are thermal bubble (also known as bubble jet) and piezoelectric.

FIG. 4A is a cross-sectional view of a typical bubble jet printhead 40 used in a thermal inkjet printer. In the printhead 40, a heating element 41 such as a resistor creates heat that vaporizes ink in a reservoir 42 to create a bubble. As the bubble expands, a tiny amount of the ink is emitted from a nozzle 43 onto the paper. When the bubble collapses, a vacuum is created that pulls more ink into the reservoir 42 from the ink cartridge 36 (FIG. 3).

FIG. 4B is a cross-sectional view of a typical piezoelectric printhead 45 used in a piezoelectric inkjet printer. In the printhead 45, a transducer 46 such as a piezo crystal is located at the back of an ink reservoir 47. The transducer 46 receives an electric signal that causes it to vibrate. When the transducer 46 vibrates inward toward the reservoir 47, it forces a tiny amount of ink out of a nozzle 48 onto the paper. When the transducer 46 vibrates outward away from the reservoir 47, it pulls more ink into the reservoir 47 from the ink cartridge 36.

Color inkjet printers typically have several advantages when compared to other types of printers. For example, color inkjet printers are often capable of high resolutions. Current inkjet printheads can emit droplets of ink as small as 2 picoliters. This allows such printheads to produce images with resolutions exceeding 4800 dots per inch (dpi). In addition, color inkjet printers can have up to eight color ink cartridges, each having a different color of ink. This significantly broadens the range of colors produced by the printhead, and allows the printhead to produce photo-quality images that change tone gradually without discernable patterns or jumps in color. Also, the cost of color inkjet printers is significantly lower than the cost of other types of color printers.

SUMMARY

An embodiment of the present invention is a hybrid printer assembly including a laser printing subassembly operable to apply toner to a medium and an inkjet printing subassembly operable to apply ink to a medium.

Such a printer assembly is capable of providing the speed and duty cycle of a laser printer as well as the color and resolution of an inkjet printer. Each of the laser and inkjet subassemblies may be used to produce separate printouts, or the laser and inkjet subassemblies may produce different portions of the same printout. For example, the laser subassembly may be dedicated to producing the text portions of a printout, and the inkjet subassembly may be dedicated to producing the image portions of the printout. Alternatively, the laser subassembly may be dedicated to producing the black-and-white portions of the printout, and the inkjet subassembly may be dedicated to producing the color portions of the printout.

DETAILED DESCRIPTION

Figure 1:
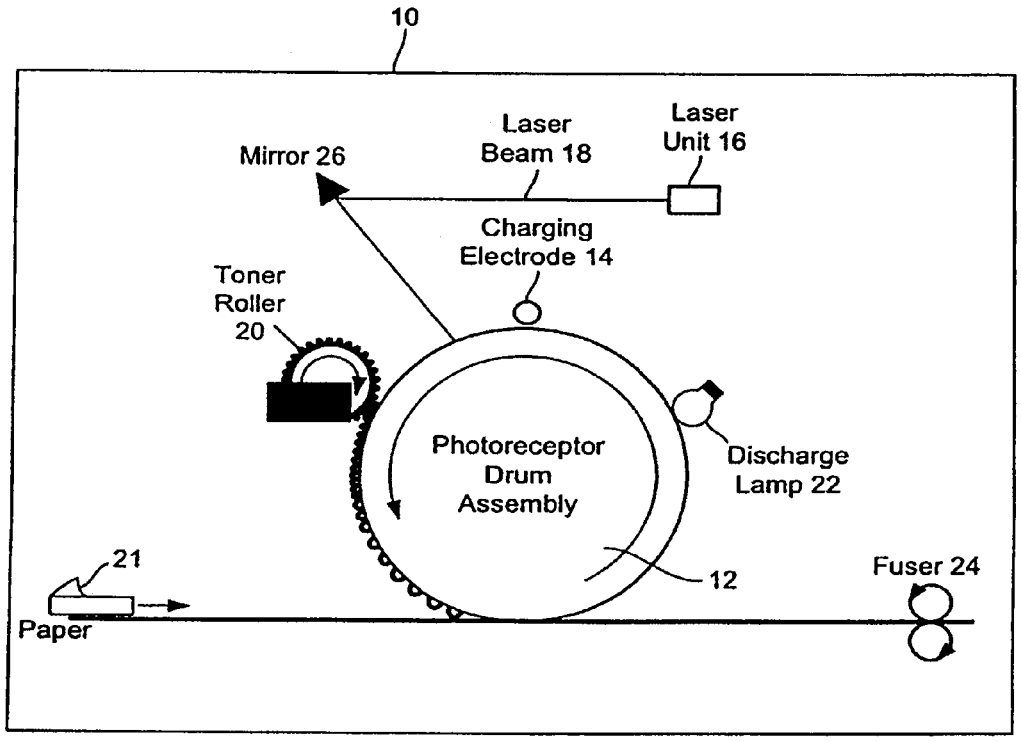
FIG. 1 (Background Art)
FIG. 1 is a cross-sectional view of a conventional laser printer.
Figure 2:
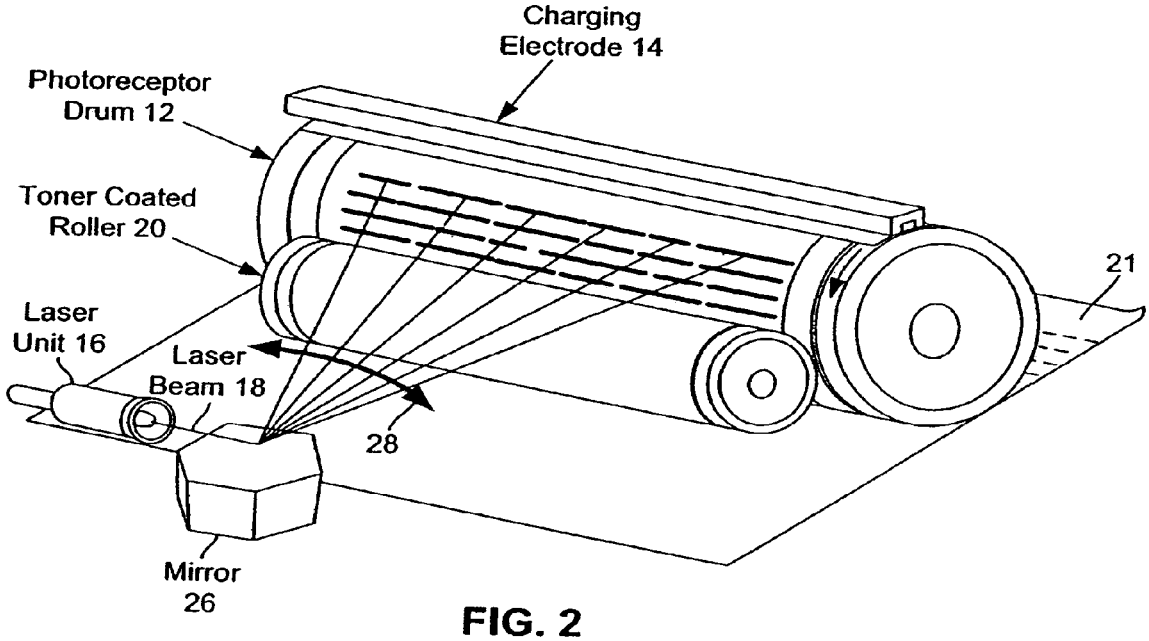
FIG. 2 (Background Art)
FIG. 2 is a perspective view of various components of the conventional laser printer of FIG. 1.
Figure 3:
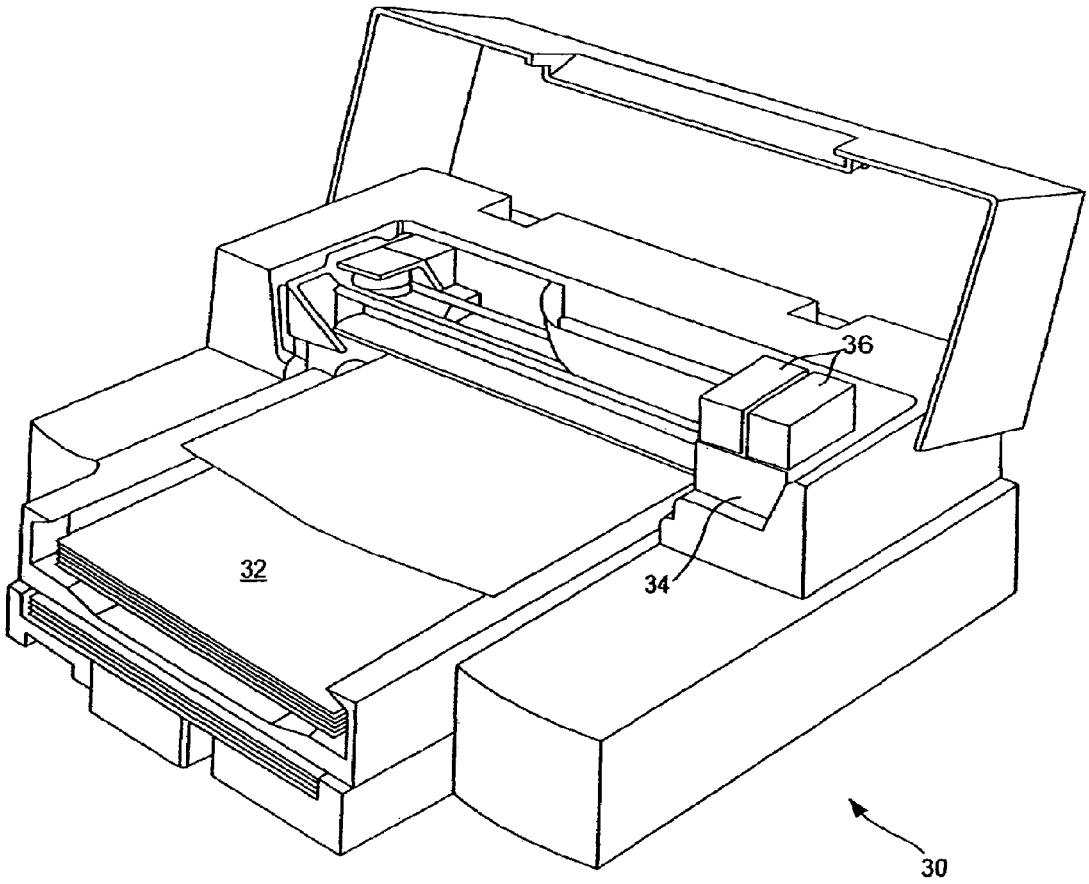
FIG. 3 (Background Art)
FIG. 3 is a perspective view of a conventional inkjet printer.
Figure 4A:
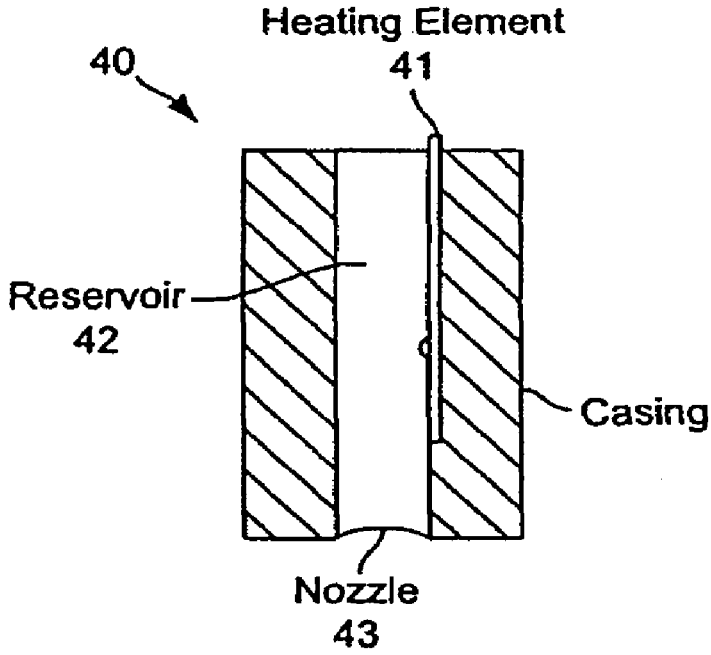
FIG. 4A Prior Art
FIG. 4A is a cross-sectional view of a conventional bubble jet printhead used in a thermal inkjet printer.
Figure 4B:
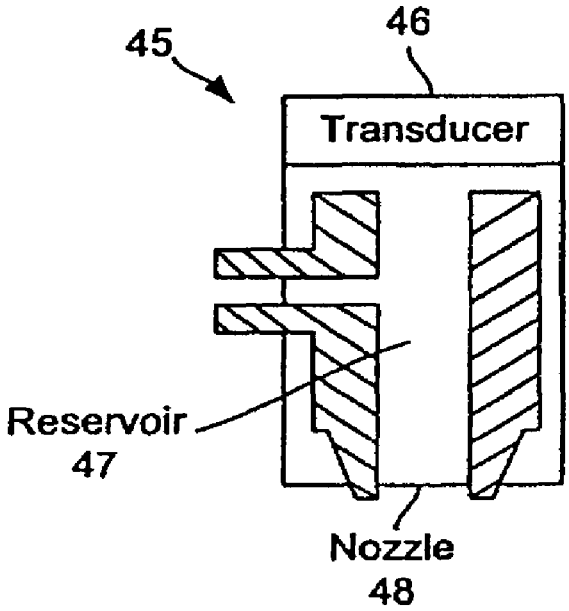
FIG. 4B Prior Art
FIG. 4B is a cross-sectional view of a conventional piezoelectric printhead used in a piezoelectric inkjet printer.
Figure 5:
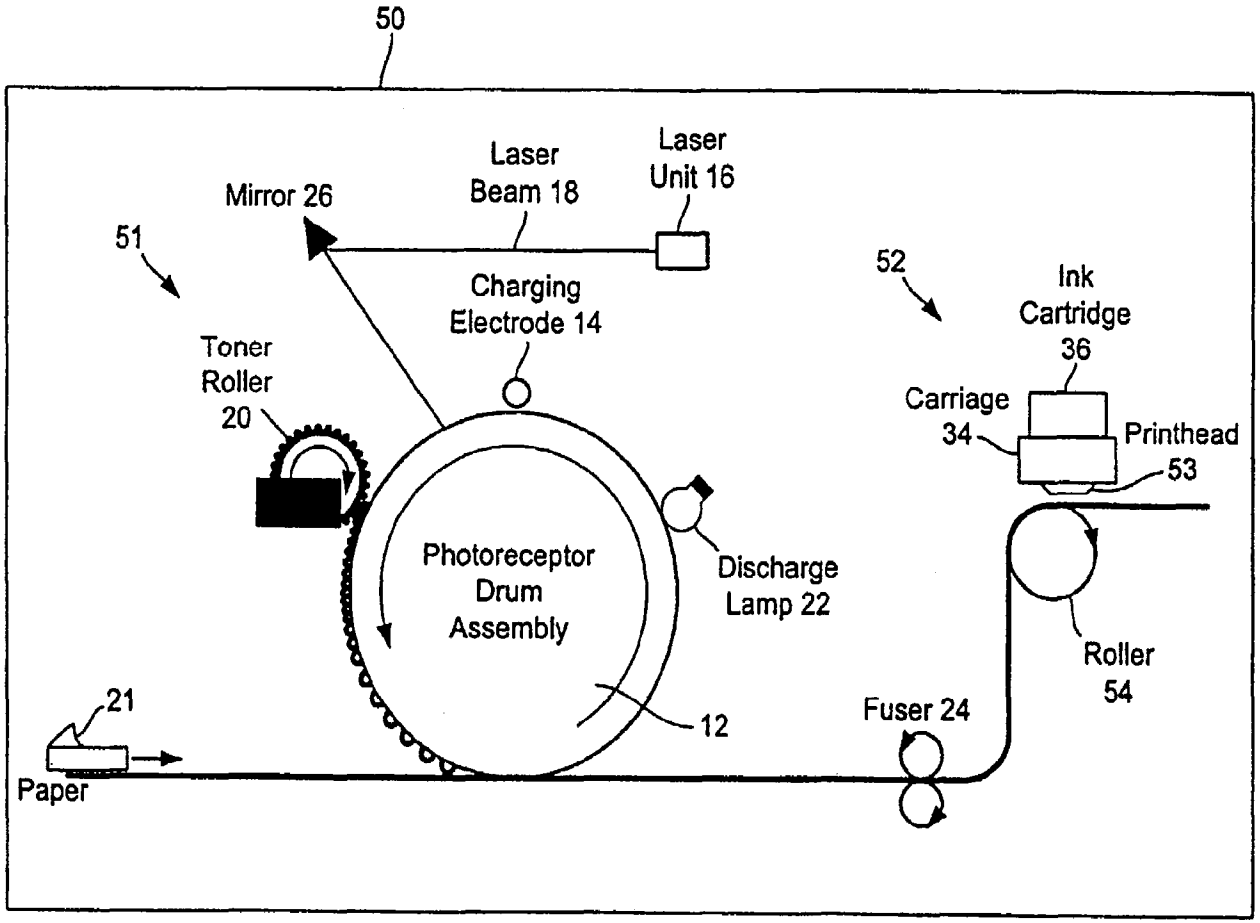
FIG. 5 is a cross-sectional view of a hybrid printing assembly that includes both laser and inkjet printing subassemblies according to an embodiment of the present invention.

FIG. 5 is a diagram of a hybrid printing assembly 50 according to an embodiment of the present invention. The hybrid printing assembly 50 includes similar components found in the laser printer 10 of FIG. 1 and the inkjet printer 30 of FIG. 3, and these components are numbered accordingly.

The photoreceptor 12, charging electrode 14, laser unit 16, laser beam 18, toner roller 20, discharge lamp 22, fuser 24 and mirror 26 are collectively referred to as a laser printing subassembly 51 of the hybrid printing assembly 50.

An inkjet printing subassembly 52 of the hybrid printing assembly 50 includes a printhead 53 and a roller 54 in addition to the carriage 34 and the ink cartridge 36.

In this example, the hybrid printing assembly 50 is oriented so that it applies toner to the print medium 21 before it deposits ink to the print medium. However, the orientation of the laser and inkjet subassemblies 51 and 52 may also be reversed so that ink is deposited before toner is applied. In addition, depending on the print job, the printer assembly 50 may use both or only one of the laser and inkjet subassemblies 51 and 52.

Also, in this example, the hybrid printing assembly 50 is utilized so that the laser subassembly 51 produces a text portion of a printout, and the inkjet subassembly 52 produces an image portion of the printout. In this way, the laser subassembly 51 uses black toner to produce text having the quality of a laser printer, and the inkjet subassembly 52 uses black and color ink to produce images having the resolution (and color) of an inkjet printer. If the printout contains only text, then only the laser subassembly 51 is used. Similarly, if the printout contains only images, then only the inkjet subassembly 52 is used. In addition, if the printout is only in black-and-white but contains both text and images, then both of the laser and inkjet subassemblies 51 and 52 are used for the text and image portions, respectively.

Because print media such as paper 21 is fed to the laser and inkjet subassemblies 51 and 52 in a serial manner, the hybrid printing assembly 50 begins operation of the laser and inkjet subassemblies at separate times and utilizes a controller (not shown in FIG. 5) to control the timing of the laser and inkjet subassemblies. The controller incorporates a time delay, which may be a predetermined line offset between the laser and inkjet subassemblies 51 and 52. For example, a line printed by the laser subassembly 51 may arrive at the inkjet subassembly 52 ten lines later, in which case the line delay is ten lines. The controller may take into account that the photoreceptor drum 12 and/or roller 54 is rotated by a stepping motor (not shown) and calculate the line delay from the number of steps made by the stepping motor. The controller may also incorporate a counter (not shown) to keep track of the number of steps made by the stepping motor to determine when to start the inkjet subassembly 52. For example, one or more small scanners (not shown) located, for example, in the inkjet printhead 53, may be used to detect a first line of the printout and the controller may then use the counter to wait a certain number of steps before the inkjet subsassembly 52 starts printing at the desired line. One manner in which the scanners may detect a first line is by detecting a registration mark produced by the laser subassembly 51. Such a registration mark is typically small enough so that it is unnoticed by the human eye, and thus does not form a visible artifact on the printed media.

The operation and additional features of the hybrid printing assembly 50 are discussed below in conjunction with FIGS. 6 and 7.

Figure 6:
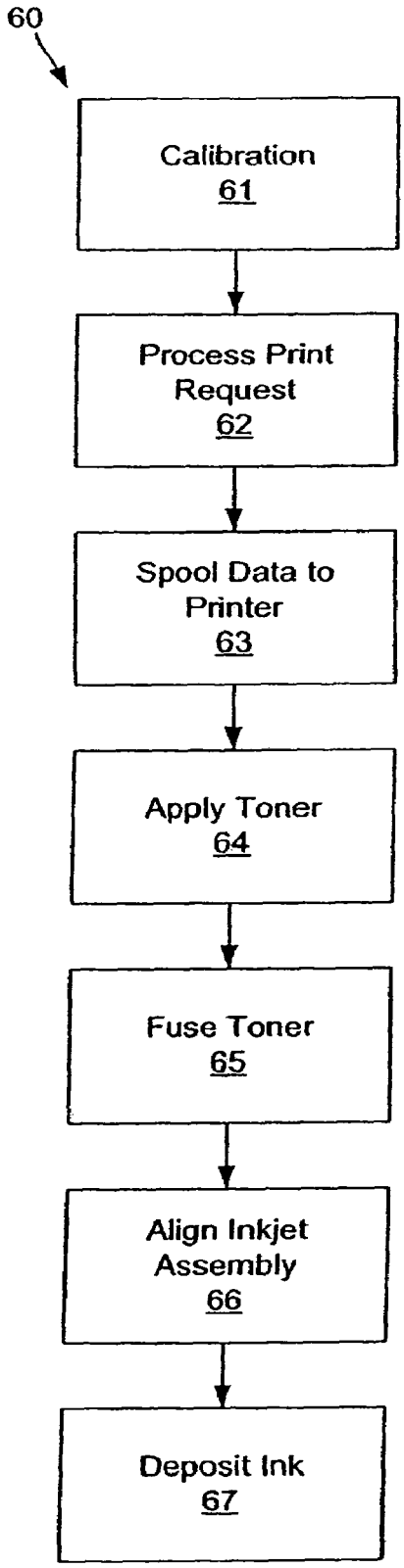
FIG. 6 is a flow chart of a procedure according to which the hybrid printing assembly of FIG. 5 operates according to an embodiment of the present invention.

FIG. 6 is a flowchart of a method 60 by which the hybrid printing assembly 50 (FIG. 5) prints on a print media such as paper 21 (FIG. 5) according to an embodiment of the present invention.

Referring to FIGS. 5 and 6, at step 61, the laser subassembly 51 and the inkjet subassembly 52 are calibrated so that the portions of the printout generated by the laser subassembly are aligned with the portions of the printout generated by the inkjet subassembly. This calibration may occur at startup of the printer, when a toner or ink cartridge is replaced, or at any other predetermined or user-specified time. For example, the printer may be instructed to print a test pattern that utilizes both the laser subassembly 51 and the inkjet subassembly 52. More specifically, the laser subassembly 51 may be instructed to print a pattern of horizontal lines on the print medium 21, and the inkjet subassembly 52 may be instructed to print a pattern of vertical lines on the print medium. If the patterns of horizontal and vertical lines are aligned within a measurable tolerance, then the laser and inkjet mechanisms are calibrated. If the patterns of horizontal and vertical lines are not aligned so that either the printer (using a built-in calibration scanner, which is not shown in the Figures) or the user measures a variation between the patterns, then the printer or the user can calibrate the inkjet subassembly 51 and/or the laser subassembly 52 so that the patterns are aligned within the measurable tolerance. This may be done in one location or in a number of locations across the print medium.

Figure 7:
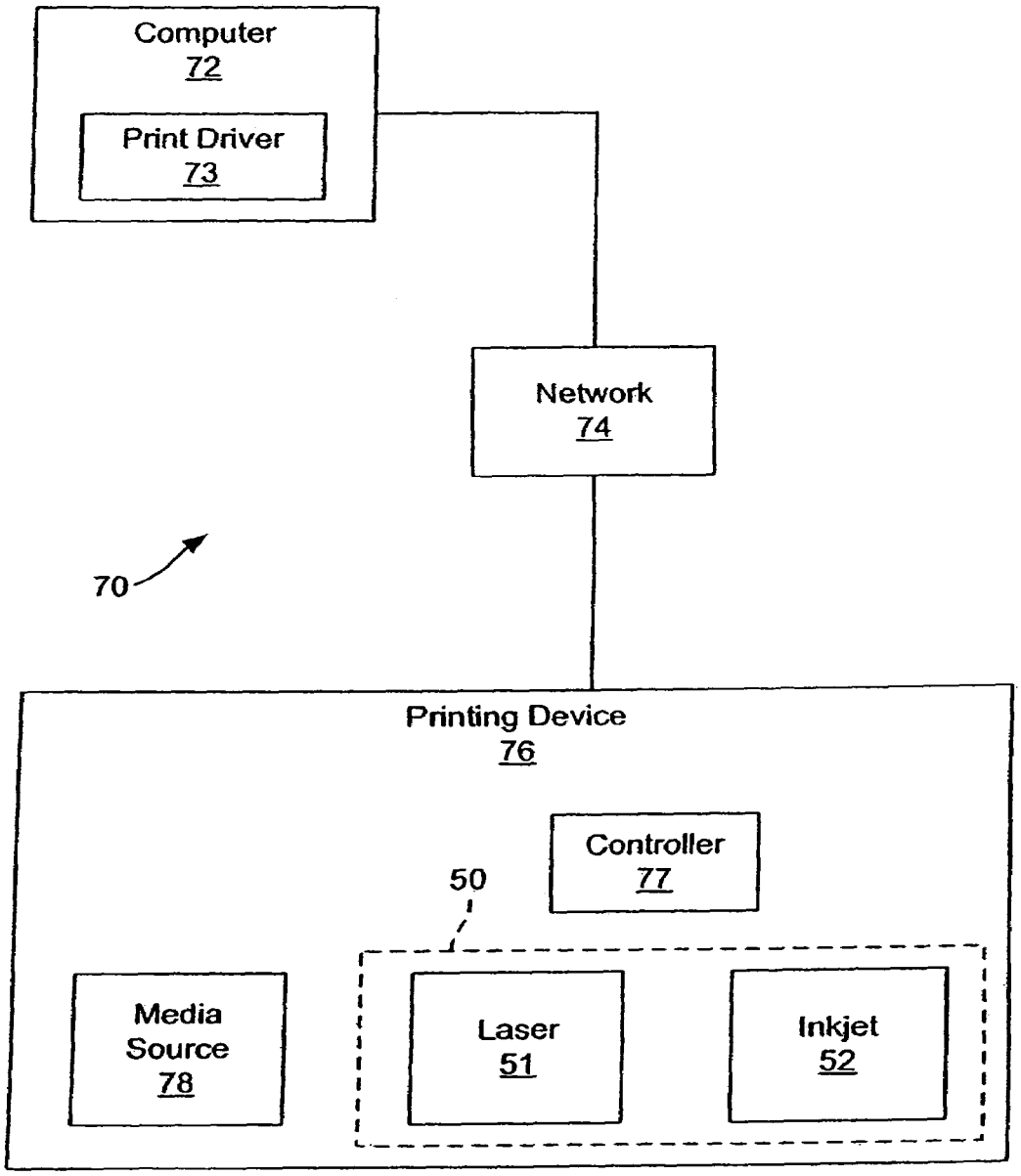
FIG. 7 is a block diagram of an electronic system that incorporates a printing device having the hybrid printing assembly of FIG. 5 according to an embodiment of the present invention.

At step 62, a print request is processed by a print driver software 73 (shown in FIG. 7). For example, the print driver 73 may determine the text and image portions of the printout. In addition, the print driver 73 may determine the black-and-white and color portions of the printout. The manner in which the print driver 73 processes the print request and determines the different portions of the printout depends on the manner in which the laser and inkjet subassemblies 51 and 52 are utilized to produce the printout.

At step 63, the data for each portion of the printout is spooled from the print driver 73 to a printer 76 (shown in FIG. 7). For example, the printer 76 may have a single controller 77 (shown in FIG. 7) for controlling both the laser and inkjet subassemblies 51 and 52. The controller 77 may receive the data for the text and image portions of the printout; alternatively, the controller may receive the data for the black-and-white and color portions of the printout.

At step 64, assuming the operation of the laser subassembly 51 begins before the operation of the inkjet subassembly 52, toner is applied to the print medium 21. For example, the toner may represent only the text portion of the printout. In this case, the laser subassembly 51 produces only the text portion of the printout—text within the images may be considered text, and thus be printed with the laser subassembly 51, or may be considered part of the image, and thus be printed with the inkjet subassembly 52—and the inkjet subassembly 52 produces the entire image portion of the printout, including the black and color portions of the images. Consequently, the inkjet subassembly 52 includes a black ink cartridge in addition to the color ink cartridges. Furthermore, the images of the printout typically have high consistency and resolution because there is no resolution mismatch between the black and color portions of the images. In addition, because only ink is used in the images, any contrast between ink and toner in the images is eliminated. Moreover, the absorption of the ink into the print medium 21 is not interfered with or hindered by any fused toner in the images.

At step 65, the toner is fused to the print medium 21. For example, the print medium 21 may pass through a fuser 24 shortly after the toner is applied. All of the toner portions of the printout may be fused to the print medium 21 before any ink is deposited to the print medium. Alternatively, even if all of the toner portions of the printout are not yet fused to the print medium 21, ink may still be deposited to those portions of the print medium where toner has already been fused to the print medium.

At step 66, the inkjet subassembly 52 begins printing at the correct time relative to the portions of the printout generated by the laser subassembly 51. For example, the timing may be calculated after toner has been fused and before ink has been deposited. As discussed above, the controller 77 controls the timing of the laser and inkjet subassemblies 51 and 52, and incorporates a time delay which may be a predetermined line offset between the laser and inkjet subassemblies. The controller 77 may calculate the line offset from a number of steps made by the stepping motor rotating the photoreceptor drum 12, and keep count of the number of steps with a counter. Based on the number of steps made by the stepping motor, the controller 77 is able to determine when to start the inkjet subassembly 52. For example, small scanners (not shown) may be included in the inkjet printhead 53 to detect a first line of the printout, and the controller 77 may use the counter to wait a certain number of steps after detecting the first line before the inkjet subassembly 52 begins printing at the desired line. One manner in which the small scanners in the inkjet subassembly 52 may detect a first line is by detecting a registration mark produced by the laser subassembly 51 as discussed above in conjunction with FIG. 5. In addition, the small scanners in the inkjet subassembly 52 may be utilized for registration to detect various other aspects of the toner portion of the printout so that the inkjet printhead 53 is aligned properly and begins depositing ink at the proper location.

At step 67, ink is deposited by the inkjet subassembly 52 to the print medium 21. For example, if the inkjet subassembly 52 includes black and color ink cartridges, then the inkjet printhead 53 deposits black ink as well as color ink in this step to produce the image portions of the printout.

Methods and printers according to embodiments of the present invention may include various modifications to the steps of method 60, including changes to the sequence of the steps and additional steps. For example, the embodiment described in FIG. 6 is a method where the laser and inkjet subassemblies 51 and 52 are calibrated at either startup of the printer, when a toner or ink cartridge is replaced, or at any other user-specified time. However, additional embodiments may use each print job for calibration so that the laser and inkjet subassemblies 51 and 52 are calibrated dynamically. For example, dynamic calibration may occur after each print job has been completed. In this case, a specific location of the completed printout may be analyzed to see if a toner mark produced by the laser subassembly 51 is aligned with an ink mark produced by the inkjet subassembly 52. If the toner and ink marks are not aligned, the necessary calibration may take place in either the laser or inkjet subassemblies because the print job has already been completed. But it may be simpler and more cost effective for the calibration to take place in the inkjet subassembly 52 because the inkjet subassembly moves across the page while printing on the medium, so the position of the inkjet subassembly can be calibrated relatively easily.

Additional embodiments may also have separate controllers for each of the laser and inkjet subassemblies. In this case, the controller for the laser subassembly may receive the data for the text portions of the printout, and the controller for the inkjet subassembly may receive the data for the image portions of the printout. Or alternatively, the controller for the laser subassembly may receive the data for the black-and-white portions of the printout, and the controller for the inkjet subassembly may receive data for the color portions of the printout.

Furthermore, instead of the toner representing only the text portions of a printout, the toner may also represent all of the black-and-white portions of the printout. In this case, the laser subassembly produces not only the black text portion of the printout, but also the black portion of the images in the printout. This makes a black ink cartridge in the inkjet subassembly unnecessary because the inkjet subassembly produces only the color portions of the printout.

Additional embodiments may also deposit the ink prior to applying the toner. In this case, the printer may first deposit the ink, then align the laser assembly, and then apply and fuse the toner to complete the printout.

Furthermore, it is not necessary that both of the laser and inkjet subassemblies be used. Depending on the requirements of the printout, one of the laser and inkjet subassemblies may not be used. For example, if the printout only contains text or black-and-white portions, then the inkjet subassembly may not be used. Or alternatively, if the printout only contains image or color portions, then the laser subassembly may not be used.

It should be noted that the inkjet printhead may be any type of inkjet printhead, including thermal bubble and piezoelectric. In addition, the laser printing subassembly may be any type of laser subassembly, including those having rotating mirrors and oscillating mirrors.

It should also be noted that, although the beam utilized to discharge the photoconductive drum has been described as a laser beam, other beam-generating sources may be used as well if suitable in particular applications. Thus, the term laser beam is not limited to a beam of light generated by a laser, but instead should be construed broadly.

Consequently, a printer having the hybrid printing assembly 50 often provides several advantages over the prior art. For example, the printer provides the speed, cost per page, and text quality of a laser printer, as well as providing the image quality of an inkjet printer. Furthermore, the printer is typically less complex than a color laser printer, and less expensive than the combined cost of a laser printer and an inkjet printer.

FIG. 7 is a block diagram of an electronic system 70, which includes a printing device 76 that incorporates the hybrid printing assembly 50 of FIG. 5 according to an embodiment of the present invention. The printing device 76 may be a printer, copier, or any device that generates a printed media. In addition to the printing device 76, the electronic system 70 includes a computer 72 connected to the printing device 76 by a network 74 and including the print driver 73. The printing device 76 includes a controller 77 and a media source 78.

The print driver 73 is a software program stored in the computer 72 for processing a print job and determining the various portions of the printout, including text, image, black-and-white, and color portions. After determining the portions of the printout, the print driver 73 spools the appropriate print data to the printing device 76 through the network 74.

The network 74 may be any type of network connection between the computer 72 and the printing device 76, including a wireless network connection.

The controller 77 receives the print data from the print driver 73. Then the controller 77 determines which data to provide to the laser printing subassembly 51 and which data to provide to the inkjet printing subassembly 52. For example, the controller 77 may provide data representing the text portions of the printout to the laser subassembly 51 and provide data representing the image portions of the printout to the inkjet subassembly 52. Alternatively, the controller 77 may provide data representing the black-and-white portions of the printout to the laser subassembly 51 and provide data representing the color portions of the printout to the inkjet subassembly 52. The controller 77 also controls the operation and timing of the laser subassembly 51 and the inkjet subassembly 52.

The media source 78 provides the print media 21 to the hybrid printing assembly 50. For example, the media source 78 may include one or more media trays or manual media feeds.

Alternative embodiments of the electronic system 70 are contemplated. For example, the print driver 73 may be located in the printing device 76, and the controller 77 may be located in the computer 72.

From the foregoing it will be appreciated that, although specific embodiments of the invention have been described herein for purposes of illustration, various modifications may be made without deviating from the spirit and scope of the invention.

What is claimed is:

1. A hybrid printing assembly comprising:

a controller;

a first printing subassembly in communication with the controller and operable to produce a first pattern by applying a first printing agent to a medium in a first manner, wherein the first printing subassembly is operable, via the controller, to produce the first pattern during a first time period; and a second printing subassembly in communication with the controller, wherein the second printing subassembly receives the medium from the first printing subassembly and is operable to produce a second pattern by applying a second printing agent to the medium in a second manner, wherein the second printing subassembly is operable, via the controller, to produce the second pattern during a second time period that is different from but overlaps the first time period, wherein the controller incorporates a time delay between the first printing subassembly and the second printing subassembly.

2. The hybrid printing assembly of claim 1 wherein the first and second patterns overlap.

3. The hybrid printing assembly of claim 1 wherein the first pattern comprises a black-and-white pattern and the second pattern comprises a color pattern.

4. The hybrid printing assembly of claim 1 wherein the first pattern comprises text and the second pattern comprises an image.

5. The hybrid printing assembly of claim 1 wherein the first printing subassembly comprises a laser printing subassembly that is operable to produce the first pattern by applying toner to the medium and the second printing subassembly comprises an inkjet printing subassembly that is operable to produce the second pattern by applying ink to the medium.

6. The hybrid printing assembly of claim 1, further comprising a media source disposed in a housing and operable to provide first and second media to the first and second printing subassemblies, respectively.

7. The hybrid printing assembly printing device of claim 6, wherein the first medium is the same as the second medium.

8. The hybrid printing assembly printing device of claim 1, further comprising a scanning element disposed in a housing.

9. The hybrid printing assembly printing device of claim 1, wherein the controller executes a print driver that causes the controller to generate respective print data for the first and second printing subassemblies.

10. The hybrid printing assembly of claim 1, further comprising a scanning element.

11. The hybrid printing assembly of claim 1, wherein the time delay is a predetermined line offset between the first printing subassembly and the second printing subassembly.

12. The hybrid printing assembly of claim 11, further comprising:

a stepping motor that rotates a photoreceptor drum of the first printing subassembly, wherein the controller calculates the line delay from a number of steps made by the stepping motor.

13. The hybrid printing assembly of claim 11, further comprising:

a stepping motor that rotates a roller of the first printing subassembly, wherein the controller calculates the line delay from a number of steps made by the stepping motor.

14. The hybrid printing assembly of claim 11, further comprising:

a scanner to detect a first line of printout on the medium generated by the first printing subassembly; and a counter to determine when the second printing subassembly is to be started.

15. An electronic system comprising:

a copy machine, the copy machine having:

a housing; and a hybrid printing assembly disposed in the housing, the hybrid printing assembly having:

a laser subassembly operable to generate a first pattern by applying a first printing agent to a first medium and operable to generate a registration mark; and an inkjet subassembly operable to generate a second pattern by applying ink and operable to detect the registration mark.

16. The electronic system of claim 15, further comprising:

a controller configured to calibrate the inkjet subassembly with respect to the laser subassembly.

17. A hybrid printing assembly comprising:

a first printing subassembly operable to produce a first pattern by applying a first printing agent to a medium using a laser;

a second printing subassembly operable to produce a second pattern by applying a second printing agent to the medium using an inkjet printhead; and a controller configured to perform calibration of the first printing subassembly and the second printing subassembly for alignment of the first pattern and the second pattern.

18. The hybrid printing assembly of claim 17, wherein the calibration includes printing a test page.

19. The hybrid printing assembly of claim 17, wherein the controller instructs one of the first printing subassembly and the second printing subassembly to print vertical lines and the other of the first printing subassembly and the second printing subassembly to print horizontal lines.

20. The hybrid printing assembly of claim 17, wherein one of the first printing subassembly and second printing subassembly is configured to generate a registration mark and the other of the first printing subassembly and second printing subassembly is configured to detect the registration mark.

* * * * *